US011661250B2

(12) United States Patent
Rognard et al.

(10) Patent No.: US 11,661,250 B2
(45) Date of Patent: May 30, 2023

(54) CLOSURE

(71) Applicant: OBRIST CLOSURES SWITZERLAND GMBH, Reinach (CH)

(72) Inventors: Jean-Yves Rognard, Marcy-sur-Anse (FR); Daniel Holmes, Filtwick (GB)

(73) Assignee: OBRIST CLOSURES SWITZERLAND GMBH, Reinach (CH)

( * ) Notice: Subject to any disclaimer, the term of this patent is extended or adjusted under 35 U.S.C. 154(b) by 223 days.

(21) Appl. No.: 16/753,177

(22) PCT Filed: Oct. 2, 2018

(86) PCT No.: PCT/EP2018/076860
§ 371 (c)(1),
(2) Date: Apr. 2, 2020

(87) PCT Pub. No.: WO2019/068734
PCT Pub. Date: Apr. 11, 2019

(65) Prior Publication Data

US 2020/0239203 A1 Jul. 30, 2020

(30) Foreign Application Priority Data

Oct. 2, 2017 (GB) ..... 1716075

(51) Int. Cl.
*B65D 47/08* (2006.01)
*B65D 55/02* (2006.01)
*B65D 85/72* (2006.01)

(52) U.S. Cl.
CPC ..... *B65D 47/08* (2013.01); *B65D 55/02* (2013.01); *B65D 55/024* (2013.01); *B65D 85/72* (2013.01);

(Continued)

(58) Field of Classification Search
CPC ..... B65D 47/08; B65D 55/02; B65D 85/72; B65D 2251/1058; B65D 2401/00; B65D 2401/20; B65D 2401/30; B65D 55/024
See application file for complete search history.

(56) References Cited

U.S. PATENT DOCUMENTS 5,839,611 A * 11/1998 Obadia ..... B65D 47/283 222/153.14
9,382,045 B2 * 7/2016 Wohlgenannt ..... B65D 47/14
9,932,158 B2 * 4/2018 Rognard ..... B65D 47/2031

(Continued)

FOREIGN PATENT DOCUMENTS

CN 203473489 U 3/2014
WO 2010112801 A1 10/2010

(Continued)

OTHER PUBLICATIONS

Notification of Transmittal of The International Search Report and The Written Opinion of the International Searching Authority, or the Declaration issued for PCT/EP2018/076860, dated Feb. 14, 2019 (11 pages).

(Continued)

*Primary Examiner* — Frederick C Nicolas
(74) *Attorney, Agent, or Firm* — ArentFox Schiff LLP

(57) ABSTRACT

A flip-top dispensing closure is provided. The closure includes a base and a lid. The base is attachable to a container neck and includes an integral spout. The lid includes a fixing ring and a cap. The fixing ring is attachable to the base and the cap is hingedly attached to the ring. The closure is provided with tamper-evident parts including first and second parts which are initially frangibly connected to each other within the lid, and upon first opening of the cap the first and second parts are separated, one of the parts being retained by the cap and the other of the parts dropping onto the base.

18 Claims, 5 Drawing Sheets

(52) U.S. Cl.
CPC ..... *B65D 2251/1058* (2013.01); *B65D 2401/00* (2020.05); *B65D 2401/20* (2020.05); *B65D 2401/30* (2020.05)

(56) References Cited

U.S. PATENT DOCUMENTS

| | | | | |
|---|---|---|---|---|
| 9,975,669 | B2 * | 5/2018 | Pellerin | B65D 43/0235 |
| 10,442,591 | B2 * | 10/2019 | Rognard | B65D 47/0838 |
| 2008/0160149 | A1 * | 7/2008 | Nasrallah | A23L 3/16 426/521 |
| 2010/0089009 | A1 * | 4/2010 | Till | B29C 49/42 53/452 |
| 2011/0056982 | A1 * | 3/2011 | Swanick | B65D 47/0804 222/83 |
| 2011/0210145 | A1 * | 9/2011 | Fournier | B65D 35/08 222/92 |
| 2012/0067922 | A1 * | 3/2012 | Benoit-Gonin | B65D 55/024 222/153.06 |
| 2013/0119061 | A1 * | 5/2013 | Smith | B65D 47/0809 220/265 |
| 2014/0158500 | A1 * | 6/2014 | Voth | B65G 35/06 198/617 |
| 2015/0375908 | A1 * | 12/2015 | Rognard | B65D 47/0838 215/235 |
| 2016/0016703 | A1 * | 1/2016 | Muhlemann | B65D 47/0814 222/566 |
| 2016/0060007 | A1 * | 3/2016 | McPherson | B65D 41/28 220/259.3 |
| 2016/0130047 | A1 * | 5/2016 | Koenigseder | B65D 47/0804 222/556 |
| 2017/0057800 | A1 * | 3/2017 | McGowan | B01F 11/0283 |
| 2018/0141730 | A1 * | 5/2018 | Rognard | B65D 1/0246 |
| 2018/0312305 | A1 * | 11/2018 | Rognard | B65D 55/024 |

FOREIGN PATENT DOCUMENTS

| | | | |
|---|---|---|---|
| WO | 2014122314 | A1 | 8/2014 |
| WO | 2017068151 | A1 | 4/2017 |

OTHER PUBLICATIONS

Chinese Office Action issued for Chinese Application No. 201880064166.6, dated Mar. 2, 2021 (English translation of first two pages of Chinese Office Action).

* cited by examiner

CLOSURE

CROSS-REFERENCE TO RELATED APPLICATIONS

This application is the U.S. National Stage Application of International Patent Application No. PCT/EP2018/076860, filed on Oct. 2, 2018, which claims priority to GB Application No. 1716075.5, filed on Oct. 2, 2017, the contents of each of which is incorporated herein by reference in their respective entireties.

BACKGROUND

The present invention relates generally to a closure and particularly, although not exclusively, to flip-top dispensing closures and sports closure.

Some aspects of the present invention relate generally to a beverage closure for a container, for example a beverage closure which can provide some indication that the closure has been opened at least once.

It is known to provide container closures with tamper-evident drop bands which are released from the open end of a closure side wall upon first opening. Although drop bands provide some indication that the closure has been opened, because they are physically separated there is no clear indication of opening on the remaining part of the closure. It is also known to provide tear-off bands which are removed from a closure body upon first opening. However, the tear-off bands present a litter problem and a potential choking hazard because they are generally small tabs which are separated from the closure body.

SUMMARY

In some aspects and embodiments the present invention relates to closure with a tamper-evident system for ensuring that a tamper-evidencing event is shown clearly; that there is a strong visual difference between the initial, unopened condition and the condition after tamper-evidencing has been activated.

The closure may be provided with a base having a drinking spout, and a cover provided with a fixing ring and a cap. The cap is joined to the cap by a hinge. The fixing ring snaps onto the base.

The spout may be formed integrally with the base.

Some aspects of the present invention relate to an aseptic closure.

The closure may have a double hinge.

The closure may be provided with tamper-evidence in the form of two annular bands which are initially frangibly connected, but which are pulled part upon first opening.

The spout and base may be fused together in order to allow aseptic filling; in other words the spout and base are formed as part of the same component, such as a one-piece moulded component with the spout being an integral part of the base.

The "ring" of the closure may be snap fitted onto the base.

When the closure is opened for the first time a tamper-evident member or part thereof may drop onto the spout (and may be retained within the closure). In some embodiments part of the tamper-evident member remains in the cap.

A further aspect provides a flip-top dispensing closure, the closure comprises a base and a lid, the base is attachable to a container neck and includes an integral spout, the lid comprises a fixing ring and a cap, the fixing ring is attachable to the base and the cap is hingedly attached to the ring, the closure is provided with tamper-evident means comprising first and second parts which are initially frangibly connected to each other within the lid, and upon first opening of the cap the first and second parts are separated, one of the parts being retained by the cap and the other of the parts dropping onto the base.

The base may include a top deck, an annular retaining member being upstanding from the top deck and comprising cooperating retaining means for retaining the fixing ring. For example, retaining means may include an upstanding annular retention wall 43 that projects from the top deck 40 and has an annular retention hook 44.

The tamper evident part which is released onto the base may be held/retained/come to rest between the spout and the upstanding retaining member.

The first and second tamper-evident parts may comprise first and second rings. In an unopened condition one of the rings may be retained by the fixing ring and the other ring may be retained by the cap.

The cap may be attached to the ring by a double hinge arrangement.

The base may comprise a side skirt. The side skirt may be provided with screw thread formations for engaging cooperating formations on a container neck. The side skirt may include a tamper-evident band at a lower end thereof.

The fixing ring may be snap fitted onto the base.

In some embodiments the base and lid are assembled together with interference fits to give a required sealing performance.

A further aspect provides an aseptic closure for a ready-to-drink fruit juice container, comprising a closure as claimed in any preceding claim subjected to a sterilisation process.

In some embodiments the closure is adapted to be sterilised, for example by a dry aseptic technique. An aseptic closure allows it to form part of a sterile filling line in use, which means that preservatives do not have to be used with fruit juices and the like.

The present invention also provides a closure as described herein in combination with a container.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims.

DETAILED DESCRIPTION

Figure 3:
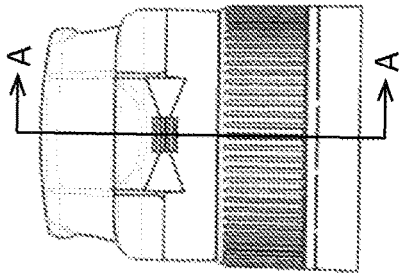
FIG. 3 illustrates a rear view of the exemplary closure of FIG. 1 in an unopened condition.

The present invention will now be more particularly described, with reference to the accompanying drawings.

All orientational terms, such as upper, lower, radially and axially, are used in relation to the drawings and should not be interpreted as limiting on the invention or its connection to a closure.

Example embodiments are described in sufficient detail to enable those of ordinary skill in the art to embody and implement the systems and processes herein described. It is important to understand that embodiments can be provided in many alternate forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed and as well as individual embodiments the invention is intended to cover combinations of those embodiments as well. On the contrary, all modifications, equivalents, and alternatives falling within the scope of the appended claims should be included. Elements of the example embodiments are consistently denoted by the same reference numerals throughout the drawings and detailed description where appropriate.

The terminology used herein is not intended to limit the scope. The articles "a," "an," and "the" are singular in that they have a single referent; however, the use of the singular form in the present document should not preclude the presence of more than one referent. In other words, elements referred to in the singular can number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art. It will be further understood that terms in common usage should also be interpreted as is customary in the relevant art and not in an idealised or overly formal sense unless expressly so defined herein.

Figure 1:
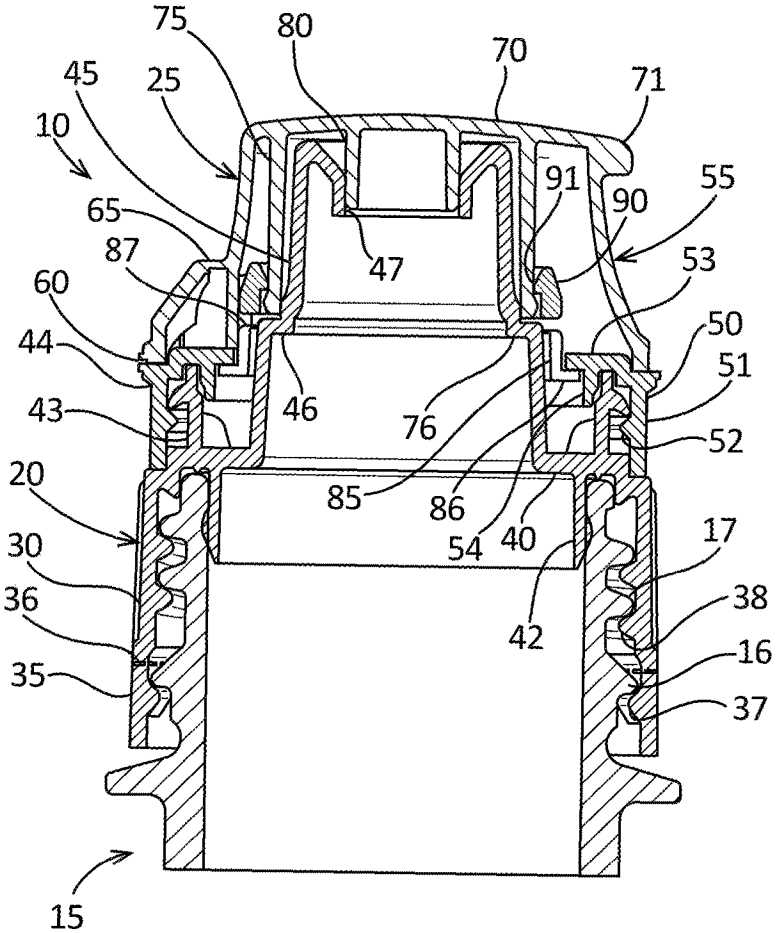
FIG. 1 illustrates a cross-sectional view of an exemplary closure.
Figure 7:
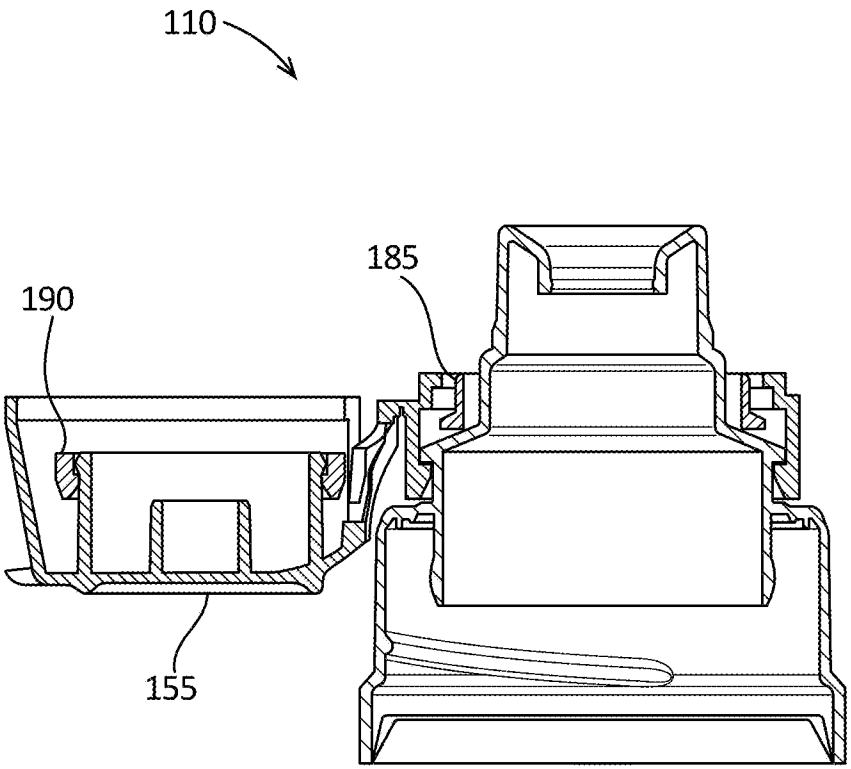
FIG. 7 illustrates a cross-sectional view of the exemplary closure of FIG. 6 in an opened condition.
Figure 6:
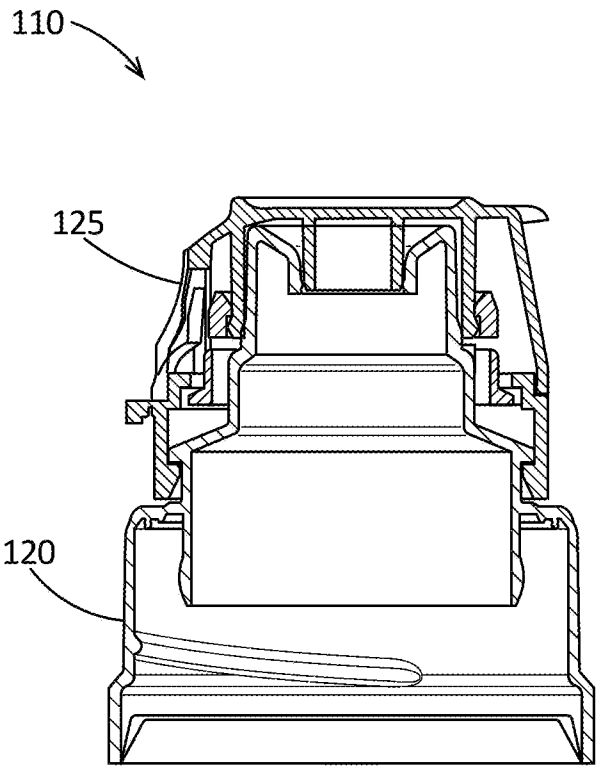
FIG. 6 illustrates a cross-sectional view of an another exemplary closure in an unopened condition.
Figure 9:
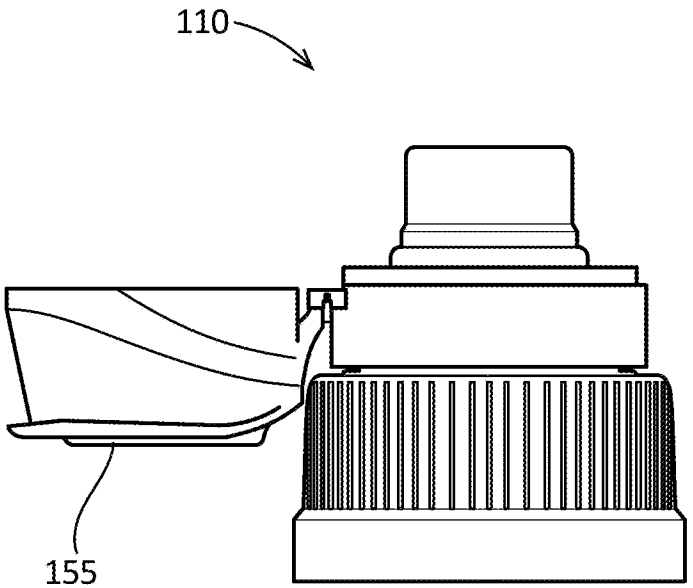
FIG. 9 illustrates a side view of the exemplary closure of FIG. 6 in an opened condition.
Figure 8:
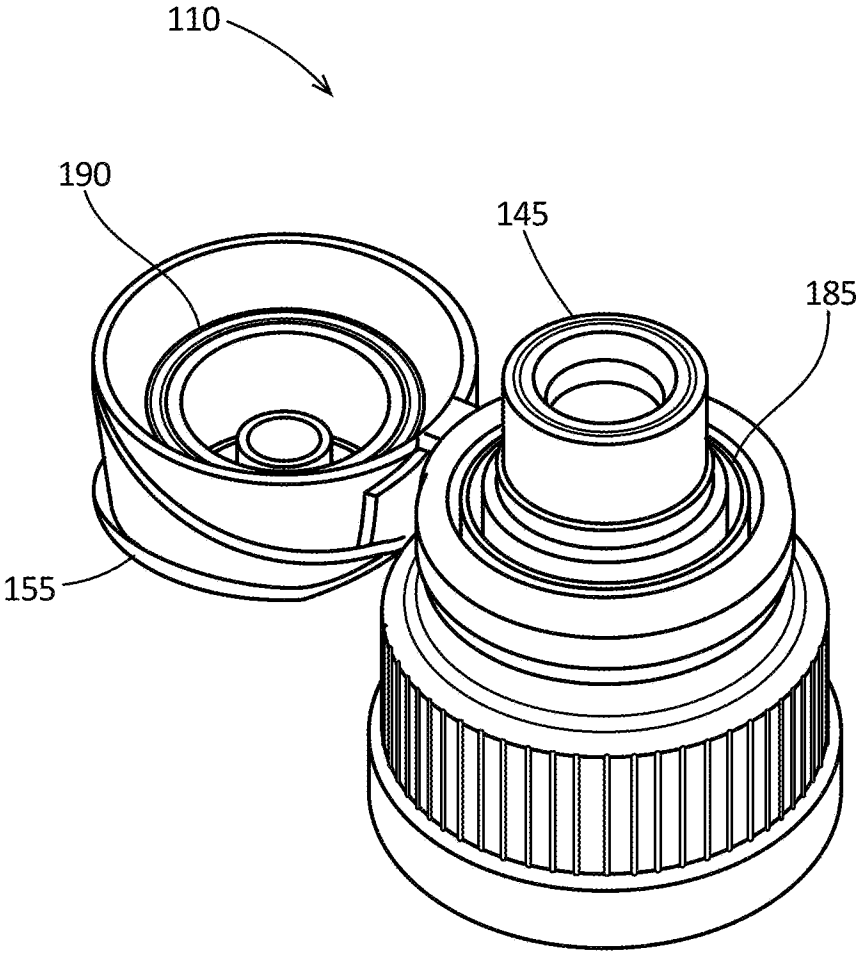
FIG. 8 illustrates a perspective view of the exemplary closure of FIG. 6 in an opened condition.

FIG. 1 shows a closure generally indicated 10 and fitted onto a container neck 15.

The closure 10 comprises a base component 20 and a lid component 25.

The base 20 comprises a generally cylindrical side skirt 30 having at one end a tamper-evident drop band 35 defined by frangible bridges 36. The interior of the skirt 30 is provided with screw thread formations 38 for engaging corresponding formations 17 on the neck 15. The interior of the drop band 35 is provided with an annular bead 37 for engaging under a retention bead 16 on the neck 15. This ensures that the band 35 is separated from the skirt 30 in the event the closure is removed from the neck.

At the other end of the skirt 30 an annular top deck 40 extends radially inwards. An annular sealing skirt 42 depends from the underside of the deck 40.

A drinking spout 45 extends from the top deck 40. The spout 45 is generally frusto-conical, and includes an intermediate ledge 46.

An upstanding annular retention wall 43 projects from the top deck 40 and has an annular retention hook 44.

The end of the spout opposite the top deck is open, and terminates with a central orifice 47.

The lid 25 comprises a fixing ring 50 and a cap or cover 55. The ring 50 is attached to the cover 55 by a double hinge arrangement comprising a first hinge 60 and a second hinge 65.

The ring 50 sits on the base 20 and has an annular side wall 51 with an internal retention bead 51 for engaging (snap fitting) under the hook 44.

From one end of the wall 51 (opposite the base) a top wall 53 extends. A sealing wall 54 depends from the underside of the wall 53 and engages on the other side of the wall 43 to the side wall 51.

The cap 55 includes a top plate 70 having a peak 71 on one side (opposite the hinges) for helping to lift the cap in use.

An exterior wall 73 depends from the top plate 70. In addition a first annular sealing wall 75 depends from the top plate 70 and engages the spout in the region of the intermediate wall 46. The wall 75 terminates with a retention bead 76.

A second (shorter) annular sealing wall 80 depends from the top plate and sealingly engages in the spout orifice 47.

A tamper evident member is provided and comprises a first ring 85 and a second ring 90. The rings 85, 90 are frangible connected together by frangible bridges 87.

The first ring 85 includes a radial ledge 86 which in the unopened condition shown engages under the ring wall 53.

The second ring 90 includes a retention hook 91 which in the unopened condition shown engages over the bead 76.

Because the spout is formed integrally with the base the closure can be sterilised using a sterilising vapour applied from below i.e. up into the spout.

In use, when the closure is used for the first time the cap 55 is lifted. The tamper-evident rings 85, 90 are pulled part (the bridges 87 are broken) as the cap moves away from the fixing ring. The first ring 85 drops onto the top deck 40 and the second ring is retained in the cap (by the bead 76). When the cap is reclosed the rings 85, 90 are axially separated as visual evidence that the closure has been opened at least once.

Figure 2:
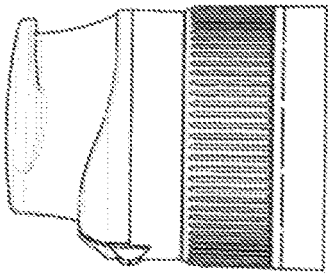
FIG. 2 illustrates a side view of the exemplary closure of FIG. 1 in an unopened condition.
Figure 4:
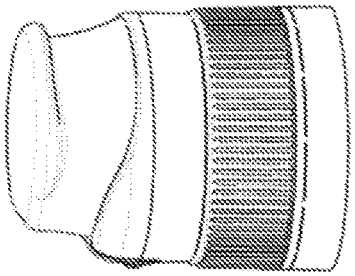
FIG. 4 illustrates a perspective view of the exemplary closure of FIG. 1 in an unopened condition.

FIG. 2 shows a side view of the closure 10 in an unopened condition. FIG. 3 is a rear view of the closure. FIG. 4 is a perspective view of the closure.

Figure 5:
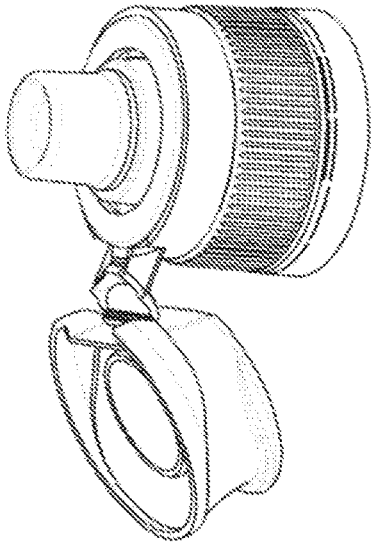
FIG. 5 illustrates a perspective view of the exemplary closure of FIG. 1 in an opened condition.

FIG. 5 shows the closure with the cap opened.

FIGS. 6 to 9 show a closure 110 formed according to a further embodiment. The hinged tamper-evident dust cover 155 is shown in closed and open positions, with the tamper-evident system shown in an inactivated and activated condition.

Figure 10:
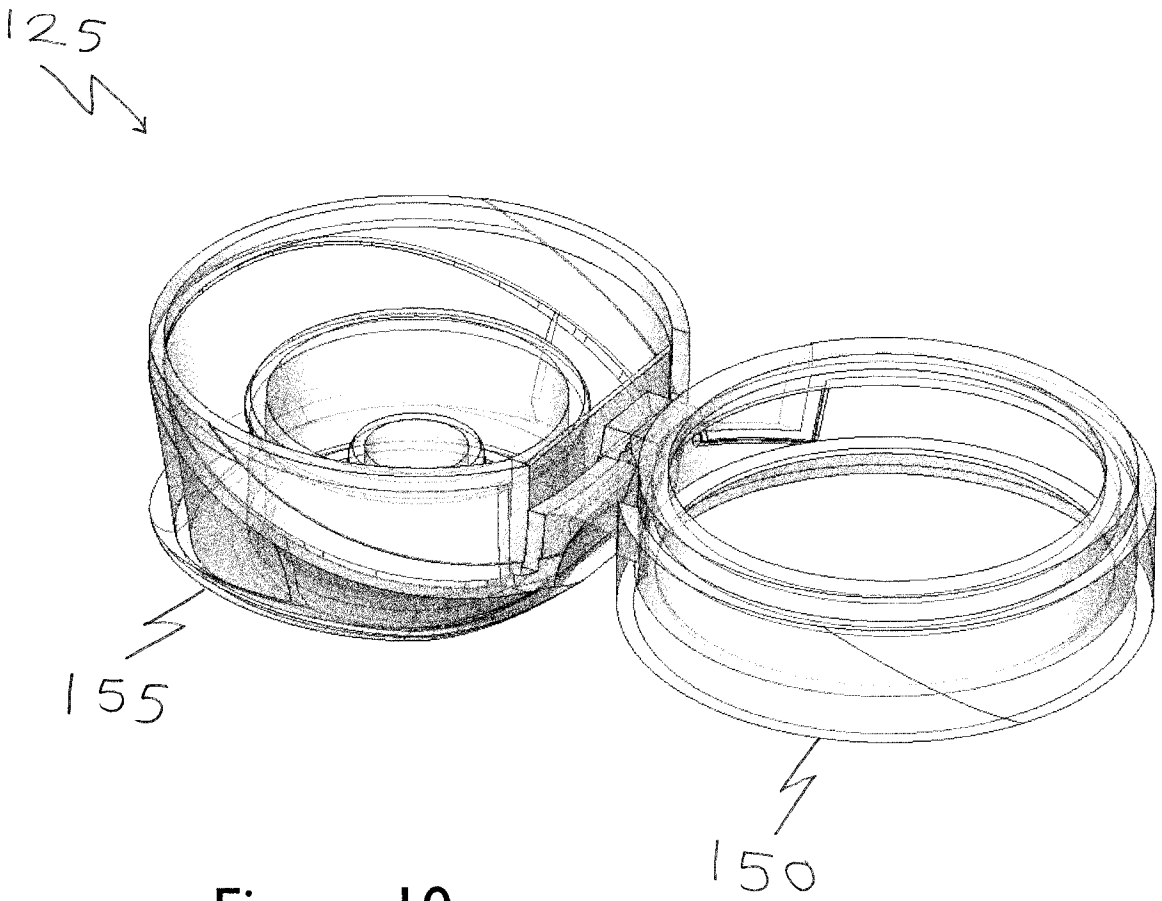
FIG. 10 illustrates a perspective view of an exemplary lid in an opened condition.

The lid 125 is shown separate from the base in FIG. 10. In this embodiment the lid is moulded in the open position shown. The cover 155 can hinge approximately 180 degrees with respect to the ring and in this embodiment has a stable open position provided for by the hinge. It can move beyond 180 degrees by virtue of the second hinge 165.

Figure 11:
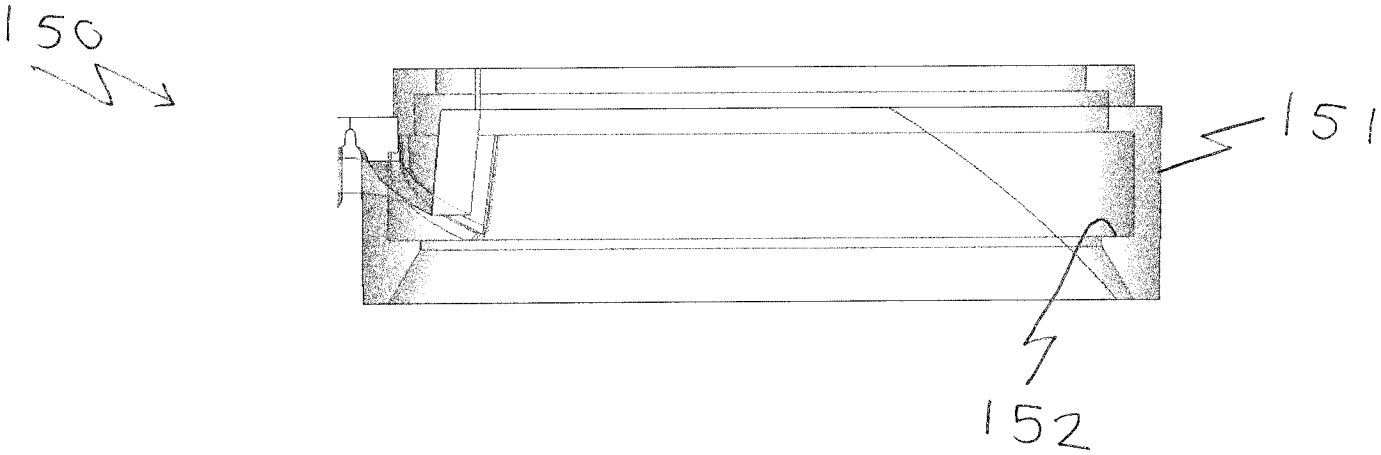
FIG. 11 illustrates a side view of an exemplary lid fixing ring.

The lid fixing ring 150 is shown in FIG. 11. The ring 150 provides strong retention by virtue of the undercut 152.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A flip-top dispensing closure, the closure comprises a base and a lid, the base is attachable to a container neck and includes an integral spout, the lid comprises a fixing ring and a cap, the fixing ring is attachable to the base and the cap is hingedly attached to the ring, the closure is provided with tamper-evident means comprising first and second tamper-evident parts which are initially frangibly connected to each other within the lid, and upon first opening of the cap the first and second parts are separated, one of the parts being retained by the cap and the other of the parts dropping onto the base, in which the base includes a top deck, an annular retaining member being upstanding from the top deck and comprising cooperating retaining means for retaining the fixing ring, and in which the second tamper-evident part which is released onto the base is retained between the spout and the upstanding retaining member.

2. A closure as claimed in claim 1, in which the first and second tamper-evident parts comprise first and second rings.

3. A closure as claimed in claim 2, in which in an unopened condition, one of the rings is retained by the fixing ring and the other ring is retained by the cap.

4. A closure as claimed in claim 1, in which the cap is attached to the ring by a double hinge arrangement.

5. A closure as claimed in claim 1, in which the base comprises a side skirt.

6. A closure as claimed in claim 5, in which the side skirt is provided with screw thread formations for engaging cooperating formations on the container neck.

7. A closure as claimed in claim 5, in which the side skirt includes a tamper-evident band at a lower end thereof.

8. A closure as claimed in claim 1, in which the fixing ring is snap fitted onto the base.

9. A closure as claimed in claim 1, in combination with a ready-to-drink fruit juice container, the closure having been subjected to a sterilisation process.

10. A closure as claimed in claim 1, in combination with a container.

11. An aseptic closure comprising:

a base and a lid, the base being attachable to a container, the closure being adapted to be sterilised, the base includes a drinking spout, and the base is a one-piece moulded component with the drinking spout being an integral part of the base to allow aseptic filling, the lid comprises a fixing ring and a cap, the fixing ring is attachable to the base and the cap is hingedly attached to the fixing ring, in which the base includes a top deck, an annular retaining member being upstanding from the top deck and comprising cooperating retaining means for retaining the fixing ring, the closure is provided with tamper-evident means, the tamper-evident means comprising a tamper-evident part and upon first opening of the cap, the tamper-evident part is released onto the base and is retained between the spout and the upstanding retaining member.

12. A closure as claimed in claim 11, in which the closure has been sterilised by a dry aseptic technique.

13. A closure as claimed in claim 11, in which the base and the lid are assembled together with interference fits.

14. A closure as claimed in claim 11, in which the tamper-evident part comprises first and second parts which are initially frangibly connected to each other within the lid, and upon first opening of the cap, the first and second parts are separated, one of the parts being retained by the cap and the other of the parts dropping onto the base.

15. A closure as claimed in claim 11, in which the tamper-evident means is provided in the form of two annular bands, which are initially frangibly connected and are pulled apart upon first opening of the cap.

16. A closure as claimed in claim 11, in combination with the container.

17. A closure as claimed in claim 11, in which the cap is attached to the ring by a first hinge and a second hinge.

18. A closure as claimed in claim 11, in which the fixing ring includes an undercut.

* * * * *